US011794792B2

(12) United States Patent
Alvarez et al.

(10) Patent No.: US 11,794,792 B2
(45) Date of Patent: Oct. 24, 2023

(54) PORTABLE HANDLE APPARATUS AND METHOD

(71) Applicants: William Alvarez, North Arlington, NJ (US); George Bender, West Caldwell, NJ (US)

(72) Inventors: William Alvarez, North Arlington, NJ (US); George Bender, West Caldwell, NJ (US)

( * ) Notice: Subject to any disclaimer, the term of this patent is extended or adjusted under 35 U.S.C. 154(b) by 775 days.

(21) Appl. No.: 16/925,959

(22) Filed: Jul. 10, 2020

(65) Prior Publication Data

US 2022/0009530 A1 Jan. 13, 2022

(51) Int. Cl.
*B25G 3/32* (2006.01)
*B61D 49/00* (2006.01)

(52) U.S. Cl.
CPC ..... *B61D 49/00* (2013.01)

(58) Field of Classification Search
CPC .. B61D 49/00; B66C 1/12; B66C 1/18; B25G 1/102; A44C 5/0092
USPC ..... 16/422, 428; 24/302; 224/221, 219; 294/75, 150
See application file for complete search history.

(56) References Cited

U.S. PATENT DOCUMENTS 659,412 A * 10/1900 McClinchie ..... G09F 23/02 40/318
766,378 A * 8/1904 Paxton ..... G09F 23/02 40/318
1,431,852 A * 10/1922 Treiber ..... B61D 49/00 40/318
4,153,189 A * 5/1979 Hughes ..... A45F 5/10 224/927
5,722,118 A * 3/1998 Hansen ..... A45F 5/102 16/113.1
5,738,398 A * 4/1998 Miano ..... B65D 63/1018 294/166
5,815,977 A * 10/1998 Hill, Jr. ..... A01K 87/00 43/25
5,878,853 A 3/1999 DeRouen
6,578,231 B1 6/2003 Godshaw
(Continued)

FOREIGN PATENT DOCUMENTS

DE 102007057590 A1 * 6/2009 ..... B60N 3/026
FR 3010013 A1 * 3/2015 ..... B60N 3/023
(Continued)

*Primary Examiner* — Chuck Y Mah
(74) *Attorney, Agent, or Firm* — Walter J. Tencza, Jr.

(57) ABSTRACT

An apparatus including a first strap configured to be placed in a straight or a curled state; and a handle attached to the first strap; and wherein the first strap in the curled state is configured attached to a subway ceiling rail. The first strap may be attached to the handle through a carabiner, a ring, and a second strap. The second strap may have a triangular section and a base of the triangular section may be attached to the handle by passing through an opening of a hollow cylindrical tube of the handle. The first strap may have first and second layers of material and a first attachment device between the layers, and a second attachment device attached to the outside of the first strap; wherein in the curled state, the first attachment device is attached to the second attachment device to hold the apparatus onto the rail.

19 Claims, 9 Drawing Sheets

(56) References Cited

U.S. PATENT DOCUMENTS

| | | | | |
|---|---|---|---|---|
| 6,824,182 | B2 * | 11/2004 | Graham | A45F 5/1026 294/137 |
| 6,901,635 | B1 | 6/2005 | Scola | |
| 7,343,647 | B1 | 3/2008 | Kinskey | |
| D578,859 | S | 10/2008 | Bednarz | |
| 8,413,304 | B1 | 4/2013 | Tipton | |
| D740,722 | S * | 10/2015 | Bennett | D12/133 |
| 9,534,749 | B2 * | 1/2017 | Dai | A44C 5/0053 |
| 10,695,603 | B1 * | 6/2020 | Lamping | A61H 3/00 |
| D929,205 | S | 8/2021 | Lessard | |
| 11,140,873 | B2 * | 10/2021 | Andaloro | A01K 27/005 |
| 2003/0070601 | A1 | 4/2003 | Lintzner | |
| 2005/0085350 | A1 | 4/2005 | Shen | |
| 2008/0235914 | A1 | 10/2008 | Dolberg | |
| 2009/0276979 | A1 * | 11/2009 | Kauffman | A45F 5/00 24/3.13 |
| 2010/0258601 | A1 * | 10/2010 | Thrope | A45C 1/00 224/267 |
| 2011/0214256 | A1 | 9/2011 | Stone | |
| 2012/0042475 | A1 | 2/2012 | Chiang | |
| 2013/0017055 | A1 | 1/2013 | Vieira | |
| 2013/0044215 | A1 * | 2/2013 | Rothkopf | G06F 1/1698 345/173 |
| 2014/0130234 | A1 * | 5/2014 | King | A41D 20/00 2/170 |
| 2016/0174668 | A1 * | 6/2016 | Script | A44B 18/0084 24/306 |
| 2018/0169496 | A1 * | 6/2018 | Torres | A63B 63/004 |
| 2019/0246614 | A1 * | 8/2019 | Healy, Jr. | A01K 97/00 |

FOREIGN PATENT DOCUMENTS

| | | | | |
|---|---|---|---|---|
| WO | WO-9302891 | A1 * | 2/1993 | B60N 3/02 |
| WO | WO-9725859 | A1 * | 7/1997 | A01K 27/003 |
| WO | WO-2005123449 | A1 * | 12/2005 | B60N 3/02 |

* cited by examiner

PORTABLE HANDLE APPARATUS AND METHOD

FIELD OF THE INVENTION

This invention relates to devices for holding onto railings which are attached to the ceilings of subway cars.

BACKGROUND OF THE INVENTION

There are various devices known in the art for holding onto railings of ceilings of subway cars.

SUMMARY OF THE INVENTION

In at least one embodiment of the present invention, an apparatus is provided comprising: a first strap which is configured to be placed in a straight state or a curled state; and a handle attached to the first strap; and wherein the first strap in the curled state is configured to be curled around a rail. The rail may be a cylindrical rail fixed to a ceiling of a subway car.

The apparatus may further include a ring, such as a hard metal ring, which is between the first strap and the handle, and wherein the first strap is attached to the handle through the ring.

The apparatus may include a carabiner which is between the first strap and the ring; and wherein the first strap is attached to the handle through the carabiner and through the ring.

The first strap may be attached to the handle through a second strap. The second strap may have a triangular section and a base of the triangular section may be attached to the handle by passing through an opening of a hollow cylindrical tube of the handle.

In at least one embodiment, the first strap may have a first layer of material and a second layer of material; wherein the first strap has a first attachment device between the first layer of material and the second layer of material; and wherein a second attachment device is attached to the outside of the first layer of material of the first strap; and wherein in the curled state, the first attachment device is attached to the second attachment device to hold the apparatus onto the rail.

The first attachment device may be attached to the second attachment device by magnetic attraction. The first attachment device may be a magnet; and the second attachment device may be flexible metal which is attracted by magnetism to the first attachment device, and which snaps to change the apparatus from the straight state to the curled state. In at least one embodiment, it is critical that the flexible metal is provided which can be snapped of flexed into the curled state from straight state to easily, and quickly snap attach or flexibly attach the first strap and the apparatus onto a rail, such as a cylindrical rail of a subway car.

In at least one embodiment, a method is provided which may include attaching an apparatus onto a rail by placing a first strap of the apparatus into a curled state; wherein the first strap which is configured to be placed in a straight state or the curled state; and wherein the apparatus includes a handle attached to the first strap. The method may further include detaching the apparatus from the rail. The apparatus may have a structure as previously described.

DETAILED DESCRIPTION OF THE DRAWINGS

Figure 1:
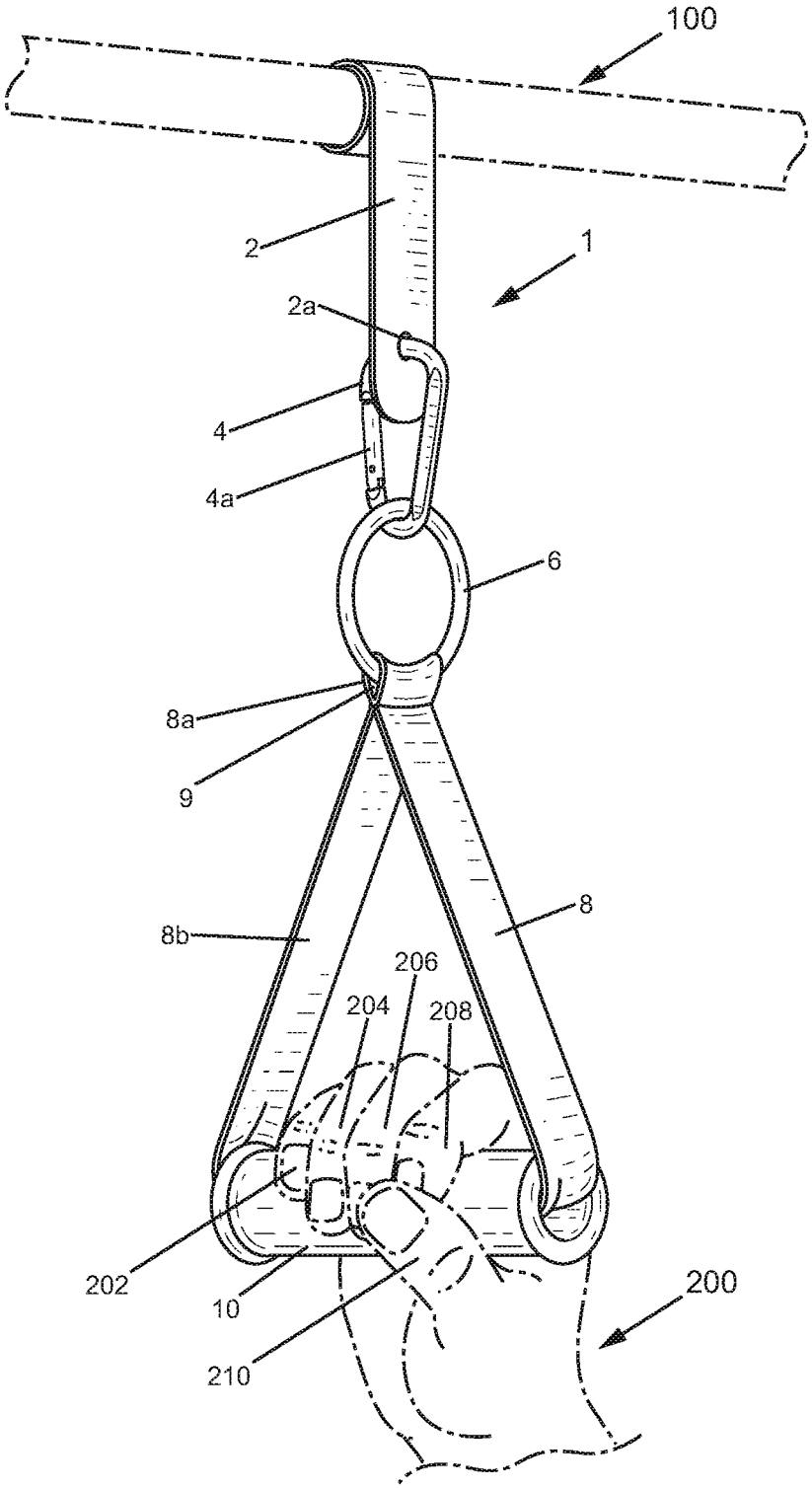
FIG. 1 is a front, top, and right perspective view of a portable handle apparatus, including a strap, wherein the strap is in a curled state in which the strap is attached to a rail, which is typically attached to a ceiling of a subway car, in accordance with an embodiment of the present invention.

FIG. 1 is a front, top, and right perspective view of a portable handle apparatus 1, including a strap 2, wherein the strap 2 is in a curled state in which the strap 2 is attached to a rail or bar 100, which is typically attached to a ceiling of a subway car, in accordance with an embodiment of the present invention.

Figure 2:
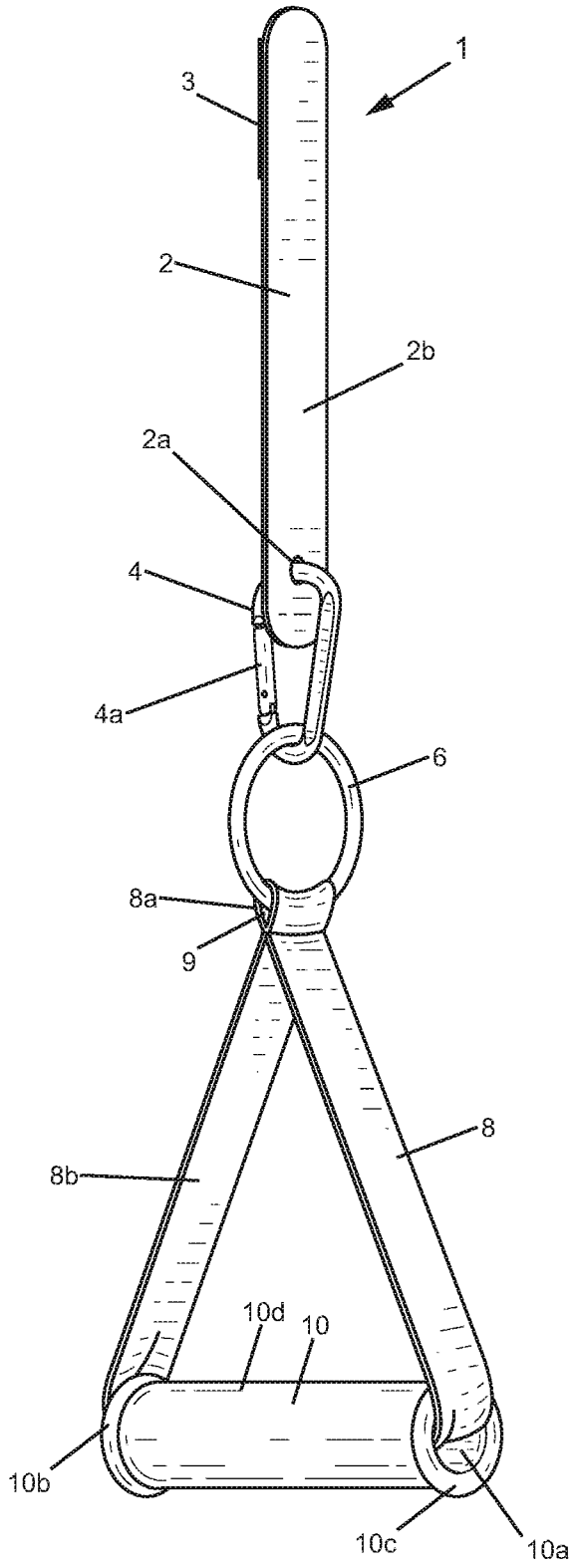
FIG. 2 is a front, top, and right perspective view of the portable handle apparatus of FIG. 1, wherein the strap is in a straight state.

FIG. 2 is a front, top, and right perspective view of the portable handle apparatus 1 of FIG. 1, wherein the strap 2 is in a straight state.

Figure 3:
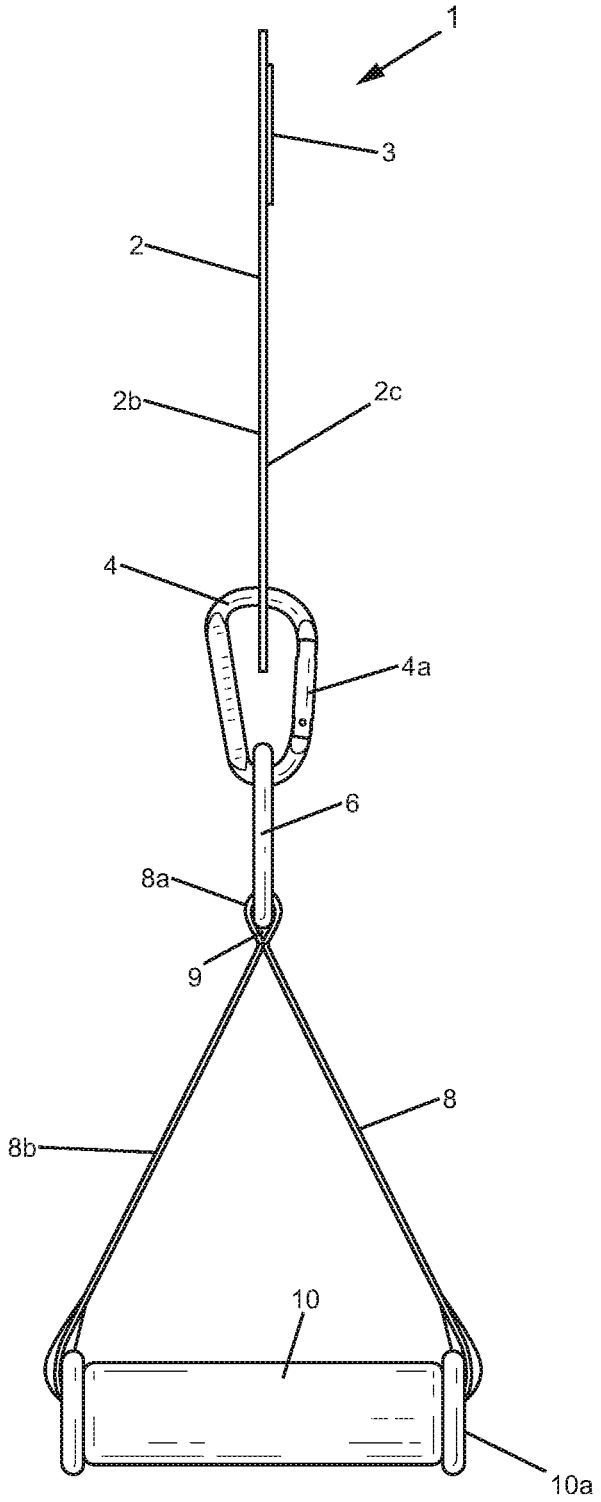
FIG. 3 is a rear elevational view of the portable handle apparatus of FIG. 1, wherein the strap is in the straight state.

FIG. 3 is a rear elevational view of the portable handle apparatus 1 of FIG. 1, wherein the strap 2 is in the straight state.

Figure 4:
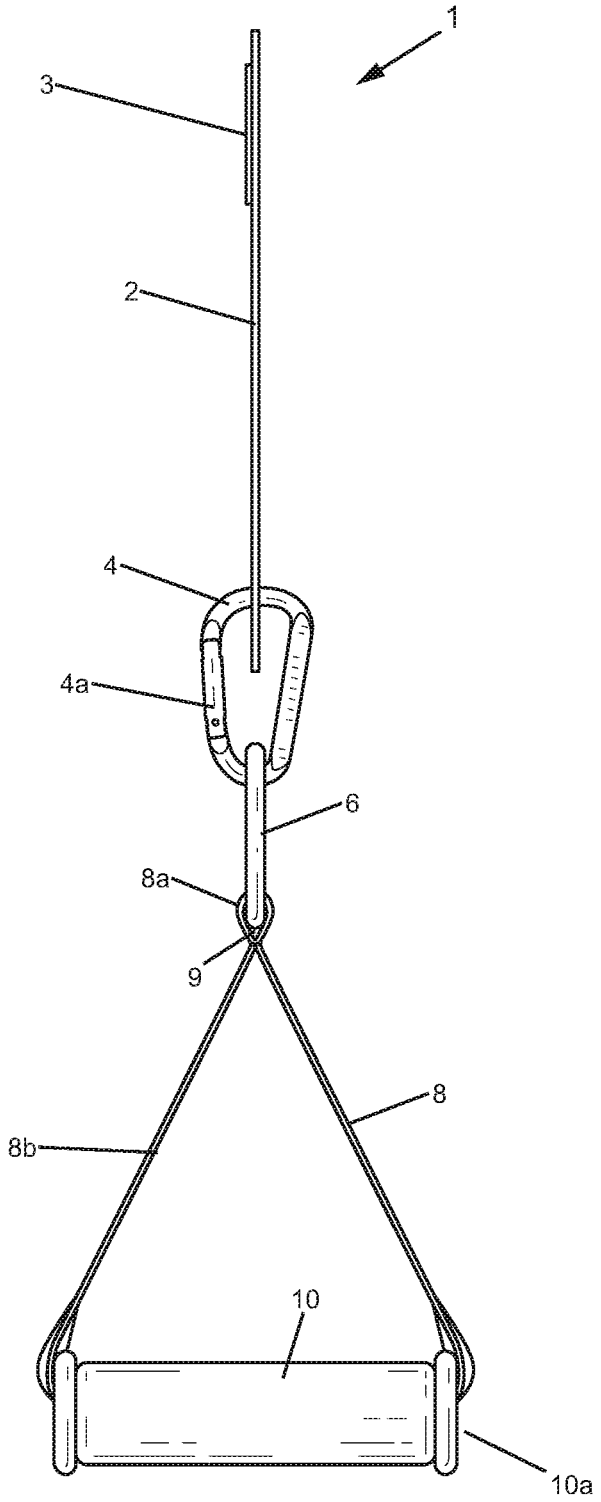
FIG. 4 is a front elevational view of the portable handle apparatus of FIG. 1, wherein the strap is in the straight state.

FIG. 4 is a front elevational view of the portable handle apparatus 1 of FIG. 1, wherein the strap 2 is in the straight state.

Figure 5:
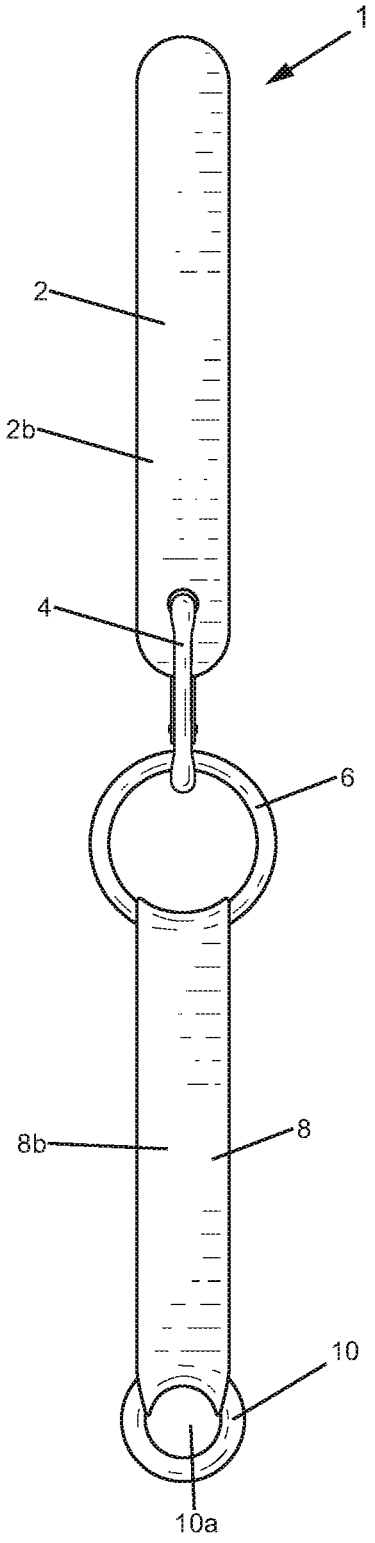
FIG. 5 is a right side elevational view of the portable handle apparatus of FIG. 1, wherein the strap is in the straight state.

FIG. 5 is a right side elevational view of the portable handle apparatus 1 of FIG. 1, wherein the strap 2 is in the straight state.

Figure 6:
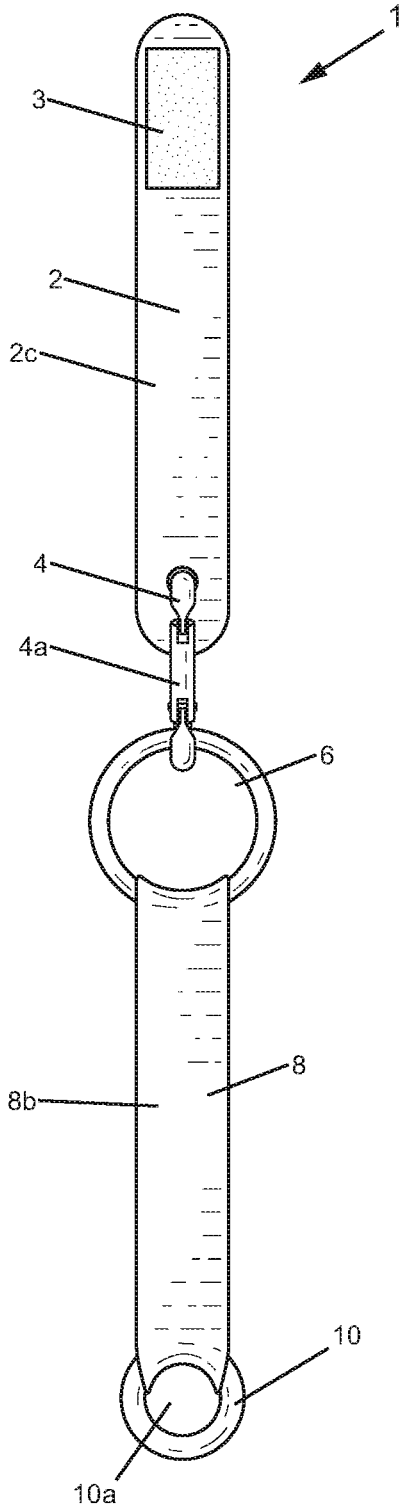
FIG. 6 is a left side elevational view of the portable handle apparatus of FIG. 1, wherein the strap is in the straight state.

FIG. 6 is a left side elevational view of the portable handle apparatus 1 of FIG. 1, wherein the strap 2 is in the straight state.

Figure 7:
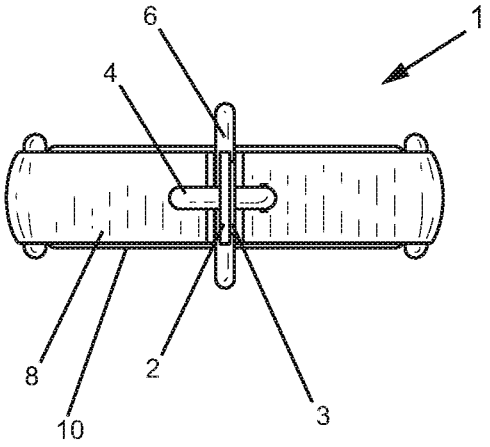
FIG. 7 is a top elevational view of the portable handle apparatus of FIG. 1, wherein the strap is in the straight state.

FIG. 7 is a top elevational view of the portable handle apparatus 1 of FIG. 1, wherein the strap 2 is in the straight state.

Figure 8:
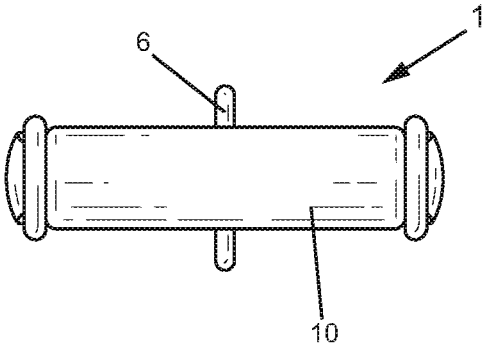
FIG. 8 is a bottom elevational view of the portable handle apparatus of FIG. 1, wherein the strap is in the straight state.

FIG. 8 is a bottom elevational view of the portable handle apparatus 1 of FIG. 1, wherein the strap 2 is in the straight state.

Figure 9:
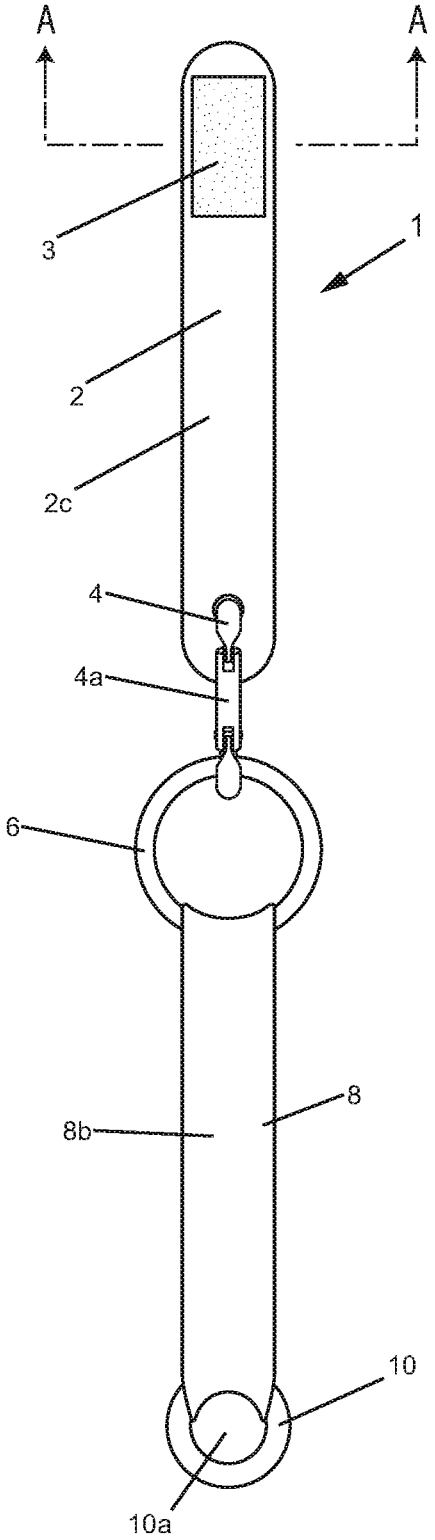
FIG. 9 is a left side elevational view of the portable handle apparatus of FIG. 1, wherein the strap is in the straight state, and showing a line A-A where a cross section is taken for FIG. 10.
Figure 10:
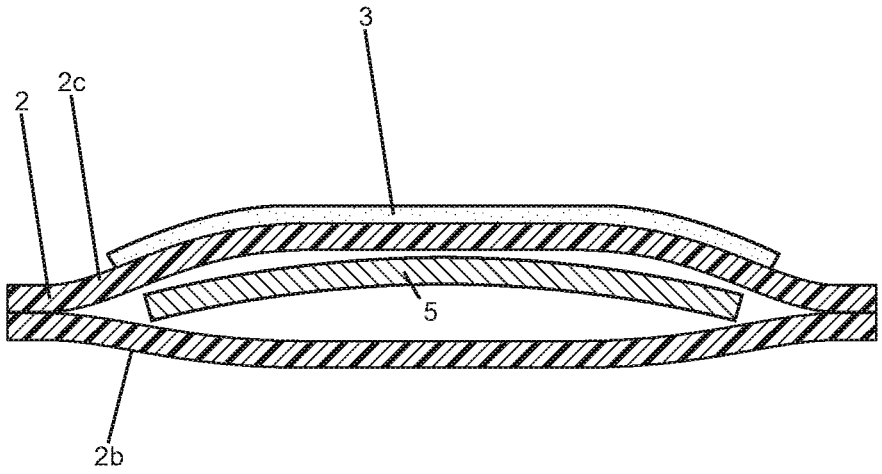
FIG. 10 is a cross section view of the portable handle apparatus of FIG. 1, wherein the strap is in the straight state, taken along the line A-A shown in FIG. 9.

FIG. 9 is a left side elevational view of the portable handle apparatus 1 of FIG. 1, wherein the strap 2 is in the straight state, and showing a line A-A where a cross section is taken for FIG. 10.

FIG. 10 is a cross section view of the portable handle apparatus 1 of FIG. 1, wherein the strap 2 is in the straight state, taken along the line A-A shown in FIG. 9.

Referring to FIGS. 1-10, the portable handle apparatus 1 includes the strap 2, a carabiner or connector 4, a ring or loop 6, a strap apparatus 8, and a handle 10.

The strap 2 may have an opening 2*a* for insertion of the carabiner 4. The strap 2 may have an attachment device 3 attached nearer a top end of the strap 2 than a bottom end of the strap 2, wherein the bottom end is connected to the carabiner 4. The attachment device 3 may be a magnet.

The carabiner 4 may be a metal loop with a spring loaded gate or section 4*a*. The carabiner 4 may be made substantially or entirely of a hard metal.

The ring or loop 6 may be made of a hard metal.

The strap apparatus 8 may have a section 8*a* formed into a tube or loop having an opening 9 through which the ring 6 is connected. The strap apparatus may also have a section 8*b* which is triangular shaped. The handle 10 may be substantially cylindrical, and may have an inner opening 10*a*, through which a portion of the strap apparatus 8 is inserted to connect strap apparatus 8 to the handle 10. Referring to FIG. 2, the handle 10 may include outer rings or flanges 10*b* and 10*c* which are larger in diameter than inner body section 10*d* shown in FIG. 2, so that a hand 200 shown in FIG. 1 can grip the handle 10 with fingers 202, 204, 206, 208, and thumb 210 surrounding inner body section 10*d* of the handle 10, without the hand 200 slipping off of the section 10*d*.

As shown in FIG. 10, the strap 2 includes a first layer 2*c* and a second layer 2*b*. In between the first layer 2*c* and the second layer 2*b* is a spring, springy material, or flexing material 5 which may run a substantial portion of a length of the elongated strap 2, and which is used to cause the strap 2 to spring or flex from the straight state of FIG. 2 to the curled or rolled state of FIG. 1.

In operation, a user may hold the apparatus 1 in the straight state of FIG. 2, by holding the bottom of strap 2, near opening 2*a*, and then the user may flex or flick the strap 2, such as by quickly flicking or snapping a wrist of the user of the hand holding the bottom of strap 2, which causes the strap 2 to change from the state of FIG. 2 to the state of FIG. 1, wrapped tightly around the bar or rail 100. In at least one embodiment, the attachment device 3 is a magnet, and aids to keep the apparatus 1 in the state of FIG. 1, because of a magnetic attraction between device 3 and inner metal piece 5, shown in FIG. 10.

The strap 2 may be elongated having a length substantially larger than its width. The lengthy of the strap 2 may be about eight inches and the width about one inch. It is critical in at least one embodiment, that the metal piece 5 be made of a metal material used for a known metal tape of a known spring return tape measure. In at least one embodiment, metal piece 5 has a length which runs for substantially all of the length of the strap 2, from the top end of the strap 2 to just prior or next to the opening 2*a* of the strap 2.

The device 3 may be a magnet which is magnetically attracted to the metal piece 5, to hold the apparatus 1 in the curled state of FIG. 1 attached to the rail 100. The device 3 may have a length of two inches and a width of one inch.

The ring 6 is a preferably smooth hard metal ring, providing a strong, smooth connection to the second strap 8 through tube section 8*a*, so that strap 8 is not torn, ripped or damaged, at the connection to ring 6. The carabiner 4 is configured to have its piece or latch 4*a* opened to allow the ring 6 to be removed from carabiner 4 along with the attached second strap 8, and handle 10. In at least one embodiment, this allows a plurality of ring 6, second strap 8, and handle 10 combinations to be attached to one carabiner 4, strap 2, rail 100 combination for a plurality of hands of a plurality of users on a subway car.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. An apparatus comprising:

a first strap which is configured to be placed in a straight state or a curled state; and a handle attached to the first strap; and wherein the first strap in the curled state is configured to be curled around a rail;

wherein the first strap has a first layer of material and a second layer of material;

wherein the first strap has a first attachment device between the first layer of material and the second layer of material;

wherein a second attachment device is attached to the outside of the first layer of material of the first strap;

and wherein in the curled state, the first attachment device is attached to the second attachment device to hold the apparatus onto the rail.

2. The apparatus of claim 1 further comprising:

a ring which is between the first strap and the handle, and wherein the first strap is attached to the handle through the ring.

3. The apparatus of claim 1 further comprising a carabiner which is between the first strap and the handle, and wherein the first strap is attached to the handle through the carabiner.

4. The apparatus of claim 2 further comprising a carabiner which is between the first strap and the ring; and wherein the first strap is attached to the handle through the carabiner and through the ring.

5. The apparatus of claim 1 wherein the first strap is attached to the handle through a second strap.

6. The apparatus of claim 5 wherein the second strap has a triangular section and a base of the triangular section is attached to the handle by passing through an opening of a hollow cylindrical tube of the handle.

7. The apparatus of claim 6 further comprising a ring which is between the first strap and the handle, and wherein the first strap is attached to the handle through the ring; and wherein the second strap has a tubular section and the ring is attached to the tubular section by passing through an opening of the tubular section.

8. The apparatus of claim 1 wherein the first attachment device is attached to the second attachment device by magnetic attraction.

9. The apparatus of claim 8 wherein the first attachment device is a magnet; and the second attachment device is a flexible metal which is attracted by magnetism to the first attachment device, and which snaps to change the apparatus from the straight state to the curled state.

10. A method comprising the steps of:

attaching an apparatus onto a rail by placing a first strap of the apparatus into a curled state;

wherein the first strap which is configured to be placed in a straight state or the curled state; and wherein the apparatus includes a handle attached to the first strap;

wherein the first strap has a first layer of material and a second layer of material;

wherein the first strap has a first attachment device between the first layer of material and the second layer of material; and wherein a second attachment device is attached to the outside of the first layer of material of the first strap;

and wherein in the curled state, the first attachment device is attached to the second attachment device to hold the apparatus onto the rail.

11. The method of claim 10 further comprising detaching the apparatus from the rail.

12. The method of claim 10 wherein the apparatus includes a ring which is between the first strap and the handle, and wherein the first strap is attached to the handle through the ring.

13. The method of claim 10 wherein the apparatus includes a carabiner which is between the first strap and the handle, and wherein the first strap is attached to the handle through the carabiner.

14. The method of claim 12 wherein the apparatus includes a carabiner which is between the first strap and the ring; and wherein the first strap is attached to the handle through the carabiner and through the ring.

15. The method of claim 10 wherein the first strap is attached to the handle through a second strap.

16. The method of claim 15 wherein the second strap has a triangular section and a base of the triangular section is attached to the handle by passing through an opening of a hollow cylindrical tube of the handle.

17. The method of claim 16 wherein the apparatus includes ring which is between the first strap and the handle, and wherein the first strap is attached to the handle through the ring; and wherein the second strap has a tubular section and the ring is attached to the tubular section by passing through an opening of the tubular section.

18. The method of claim 10 wherein the first attachment device is attached to the second attachment device by magnetic attraction.

19. The method of claim 18 wherein the first attachment device is a magnet; and the second attachment device is a flexible metal which is attracted by magnetism to the first attachment device, and which snaps to change the apparatus from the straight state to the curled state.

* * * * *